US012601198B2

(12) United States Patent
Feng

(10) Patent No.: US 12,601,198 B2
(45) Date of Patent: Apr. 14, 2026

(54) PANEL FOR A RACKABLE BARRIER

(71) Applicant: Vantage Fence USA, Sacramento, CA (US)

(72) Inventor: Shihao Feng, Sacramento (CN)

(73) Assignee: Vantage Fence USA, Sacramento, CA (US)

( * ) Notice: Subject to any disclaimer, the term of this patent is extended or adjusted under 35 U.S.C. 154(b) by 271 days.

(21) Appl. No.: 18/499,860

(22) Filed: Nov. 1, 2023

(65) Prior Publication Data

US 2025/0137286 A1 May 1, 2025

(51) Int. Cl.
*E04H 17/14* (2006.01)
*E04H 17/16* (2006.01)

(52) U.S. Cl.
CPC ..... *E04H 17/1417* (2013.01); *E04H 17/143* (2013.01); *E04H 17/1439* (2013.01); *E04H 17/1447* (2021.01); *E04H 17/1448* (2021.01); *E04H 17/146* (2021.01); *E04H 17/168* (2013.01)

(58) Field of Classification Search
CPC ..... E04H 17/1417; E04H 17/1448; E04H 17/1426; E04H 17/1439; E04H 17/145
See application file for complete search history.

(56) References Cited

U.S. PATENT DOCUMENTS

| | | | | |
|---|---|---|---|---|
| 6,341,764 | B1 * | 1/2002 | Conner | E04H 17/1439 256/19 |
| 7,677,535 | B1 * | 3/2010 | Lo | E04H 17/1439 256/65.01 |
| 7,980,534 | B1 * | 7/2011 | Gibbs | E04H 17/1439 256/22 |
| 8,523,150 | B2 | 9/2013 | Gibbs et al. | |
| 8,899,555 | B2 | 12/2014 | Sherstad | |
| 9,840,854 | B1 | 12/2017 | Gibbs et al. | |
| 10,538,939 | B1 | 1/2020 | Gibbs et al. | |
| 11,035,147 | B2 * | 6/2021 | Burt | E04H 17/1439 |
| 2005/0023514 | A1 * | 2/2005 | Gibbs | B21F 27/10 256/59 |
| 2006/0033093 | A1 * | 2/2006 | Lo | E04H 17/1448 256/65.02 |
| 2023/0123821 | A1 * | 4/2023 | Messelis | E04H 17/1439 256/24 |

* cited by examiner

*Primary Examiner* — Michael P Ferguson
(74) *Attorney, Agent, or Firm* — Miller Nash LLP

(57) ABSTRACT

A rackable panel for a barrier is disclosed. The panel includes a rail having a top wall and first and second walls extending downward from the top wall, forming a channel. The panel further includes one or more upright members, and one or more coupling systems for indirectly coupling the upright members to the rail. Each coupling system comprises a bracket having a bridge, the bracket structured to be secured to an inner surface a rail side wall; and an overlay structured to receive the bridge within a channel and be secured to an upright member. The bridge is rotatable within the channel, such that the rail can be racked at a positive or negative slope when a force is applied to the rail, while the upright members stay substantially vertical, enabling the panel to be used on a wide variety of terrains.

17 Claims, 6 Drawing Sheets

PANEL FOR A RACKABLE BARRIER

TECHNICAL FIELD

The subject matter is related to an apparatus for a barrier, and, more particularly, to a system for a rackable fence that adjusts to elevation change on uneven landscape.

BACKGROUND

Fencing systems are typically formed from several panels. Often, each fence panel will have several upright members and one or more rails joining the upright members in a row, with the upright members and rails spaced such that they create a barrier that cannot be crossed. But fencing systems must often follow uneven terrain, and the individual panels must connect such that they can accommodate elevation changes. Many standard fence panels are formed by rigidly securing the upright members and rails, preventing any adjustment of the panel along terrain. In this way, on uneven terrain, one panel may not perfectly interface with the next panel due to the two panels sitting on varying slopes. Imperfect interfacing between panels may then lead to gaps in the fencing system or areas of instability.

To fence uneven terrain, then, fence panels must often be customized such that they may individually follow the slope of the terrain on which they sit, without leaving gaps or sacrificing stability between adjacent panels. Customizing each panel, however, requires significant time and effort, as detailed measurements must be taken in advance of manufacturing the panels, and the manufacturing process differs for each custom panel. As such, manufacturing fence panels according to a single, uniform model is desirable for reducing cost, effort, and time.

Adjustable, or rackable, fence panels are available on the market, allowing uniform panels to adjust to elevation changes without hindering connection points between panels. But these panels often require a number of complex parts to be manufactured in addition to the typical components of a fence panel. Accordingly, these complex parts may add to the cost, effort, and time to manufacture and assemble fence panels, cutting against the motivation to choose adjustable panels over customized panels.

Configurations of the disclosed technology address shortcomings in the prior art.

DETAILED DESCRIPTION

As described herein, aspects are directed to a rackable fencing system. More specifically, embodiments of the present disclosure include a panel for a rackable fencing system with coupling systems to allow the panel to angularly adjust to elevation change on uneven terrain.

Figure 1A:
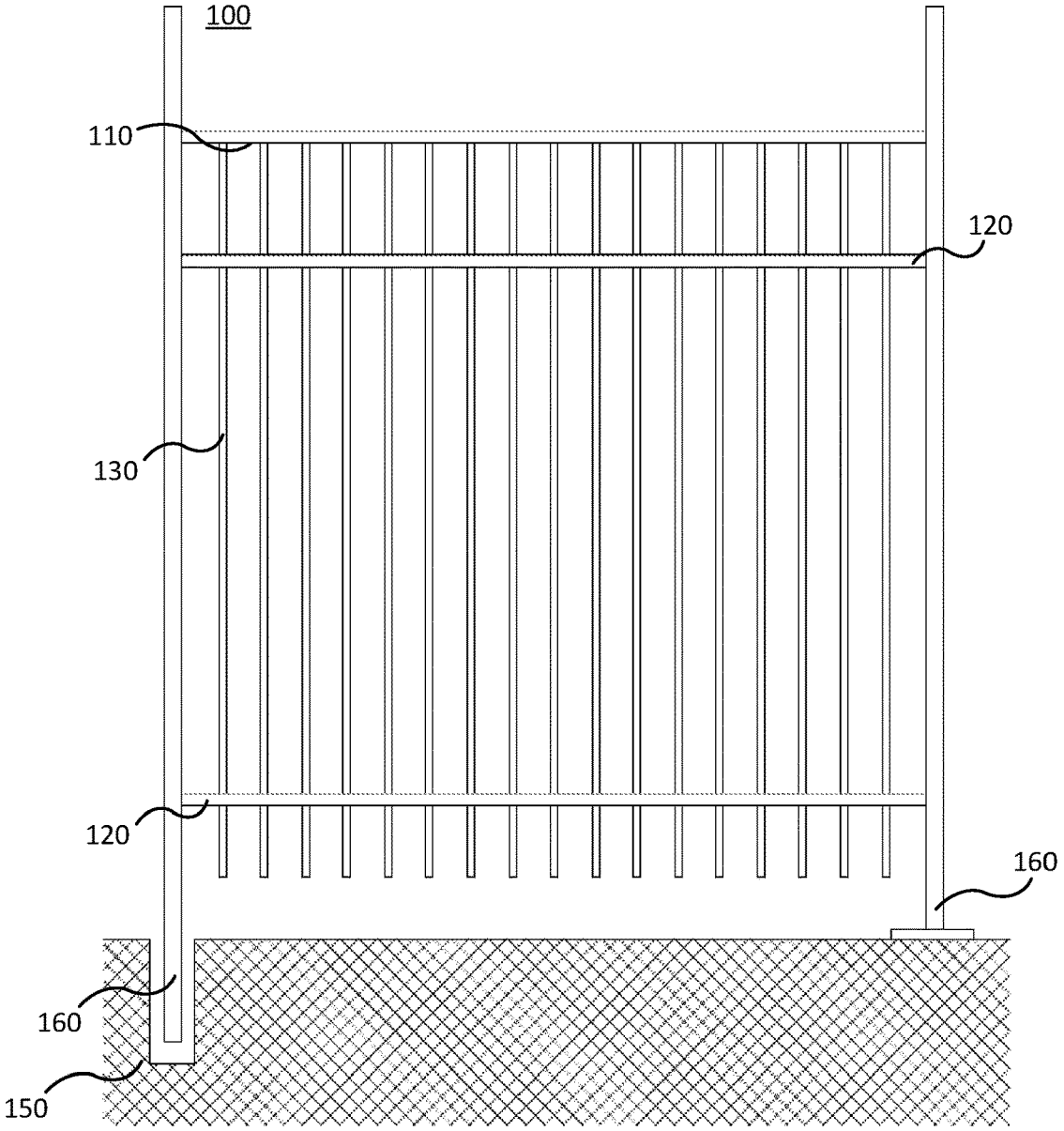
FIG. 1*a* is a front view of a panel for a rackable fencing system in a default position, according to an example configuration.

FIG. 1*a* illustrates a panel 100 of a fencing system according to embodiments of the disclosure. The panel 100 has a main rail 110 that engages with one or more upright members 130. Additionally, the panel 100 may be anchored to an anchoring surface 150, such as the ground, at posts 160 at either or both ends of the panel 100. In the illustrated position of the panel 100, which may be the default position in disclosed embodiments, the main rail 110 extends laterally along the panel 100 such that it is substantially horizontal. For purposes of this disclosure, horizontal may be defined as substantially parallel to the anchoring surface 150 when the anchoring surface 150 is substantially flat, such as flat ground. Similarly, for purposes of this disclosure, vertical may be defined as substantially parallel to the vector direction of the earth's gravity and substantially orthogonal to horizontal. In the default position of the panel 100, the one or more upright members 130 extend substantially vertically and couple with the main rail 110 in a position substantially orthogonal to the main rail 110, forming approximately ninety-degree angles with both the main rail 110 and the substantially flat anchoring surface 150 on which the panel 100 is anchored.

In embodiments, the panel 100 may also include any number of additional rails separate from the main rail 110. For instance, as illustrated in FIG. 1*a*, embodiments may include one or more secondary rails 120. In such embodiments, the one or more secondary rails 120 extend laterally along the panel 100 such that they are substantially parallel to the main rail 110, and thus substantially parallel to the anchoring surface 150 on which the panel 100 is anchored in the illustrated default position. The secondary rails 120 may also couple with the one or more upright members 130 in the same way as the main rail 110, discussed in further detail below.

Figure 1B:
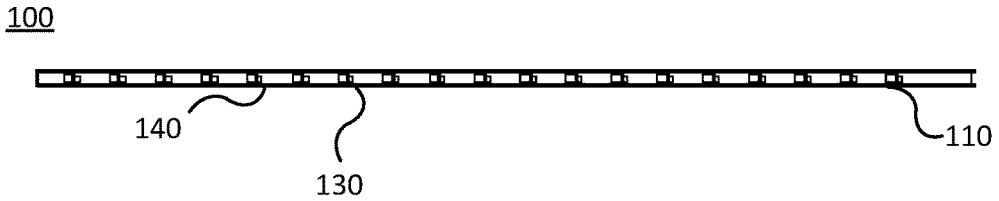
FIG. 1*b* is a cut-through top view of a portion of the panel of FIG. 1*a*, according to an example configuration.

FIG. 1*b* illustrates a cut-through top view of a portion of the panel 100. As shown, the top portion of the main rail 110 may contain one or more openings 140 for receiving the one or more upright members 130 and allowing the one or more upright members 130 to pass through the main rail 110. In embodiments including additional rails, such as the secondary rails 120 shown in FIG. 1*a*, each additional rail may also include one or more openings 140 for receiving the one or more upright members 130 and allowing the one or more upright members 130 to pass through the additional rails. In still other embodiments, the main rail 110 may not contain any openings and may instead receive the one or more upright members 130 within the main rail 110, without the one or more upright members 130 passing through the main rail 110. In such embodiments, the main rail 110 thus maintains a flat top appearance, such as shown in FIG. 1*a*. Openings 140 may be sized such that they are large enough both to receive upright members 130 and permit upright members 130 to pass through when the panel 100 is in a default position, and to permit upright members 130 to move horizontally and/or vertically with respect to rail 110 when panel 100 is in a racked position, as discussed in greater detail below. In an embodiment the panel 100 further includes one or more coupling systems 300 comprising brackets 310 and overlays 320 for indirectly coupling the one or more upright members 130 to the rail 110 and, where included, to the one or more secondary rails 120, discussed in further detail below.

Figure 1C:
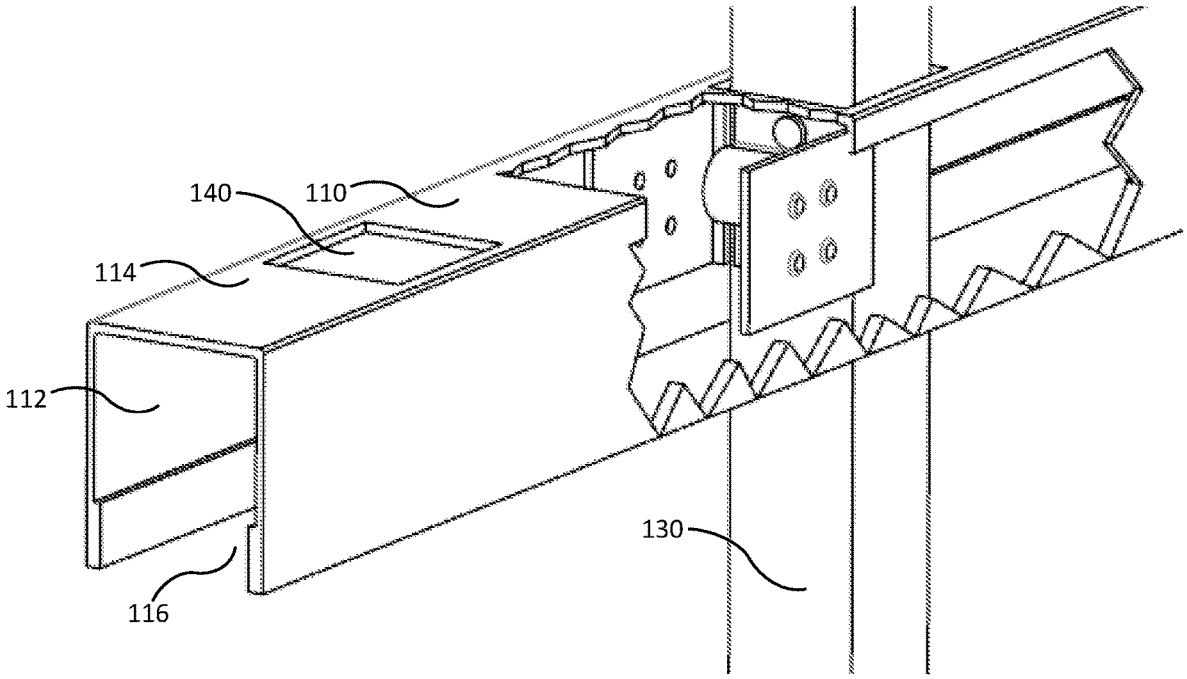
FIG. 1*c* is a cut-through side view of the rail of the panel of FIG. 1*a*, according to an example configuration.

FIG. 1*c* illustrates a cut-through side view of a portion of rail 110 according to an embodiment of the invention. Rail 110 includes a top wall 114 from which two sidewalls 112 extend substantially downward, such that rail channel 116 is formed and main rail 110 has a substantially U-shape. Sidewalls 112 may extend at substantially ninety-degree angles from the top wall 114 of the main rail 110, such that inner surfaces of the sidewalls 112 may face each other. Other embodiments may utilize different angles of extension from the main rail 110. The length of the sidewalls 112 extending away from the main rail 110 as illustrated are preferably 1.5 inches, but the length may vary in embodiments. As shown in FIG. 1*c*, the portion of each sidewall 112 which is most distal from the top wall 114 may be thicker than the portion of the sidewall 112 which is proximal to the top wall 114. In an embodiment, the difference in thickness may be such that the rail plates 314, 316 are substantially flush with the thicker portion of the sidewall when the bracket 310 is implemented in the panel, as discussed further below.

Additionally, although not illustrated, embodiments of the disclosure may include shoulders for the sidewalls 112 to enhance the strength of the main rail 110. In such embodiments, the ends of sidewalls 112 may be bent toward one another, toward the channel 116, to form the shoulders. For example, the ends of sidewalls 112 may be bent at substantially ninety-degree angles relative to the sidewall 112 such that each ninety-degree angle opens toward the rail channel 116 of the main rail 110. In another embodiment, the ends of the sidewalls 112 may be bent again, another 90 degrees, such that the ends are now bent toward the internal face of the sidewalls 112, for a total of 180 degrees of bending.

In embodiment rails that include one or more openings 140 to receive upright members 130 and permit upright members 130 to pass through the rail 110, the openings 140 are formed in the top wall 114 of the rail 110. As already discussed, in other embodiments rail 110 does not include openings 140, giving the upper rail a flat top appearance. In embodiments including additional rails, such as the secondary rails 120 shown in FIG. 1*a*, each additional rail may also include top wall 114 and sidewalls 112, which may or may not have shoulders, and one or more openings 140 in the top wall 114 for receiving the one or more upright members 130 and allowing the one or more upright members 130 to pass through the additional rails.

Figure 2:
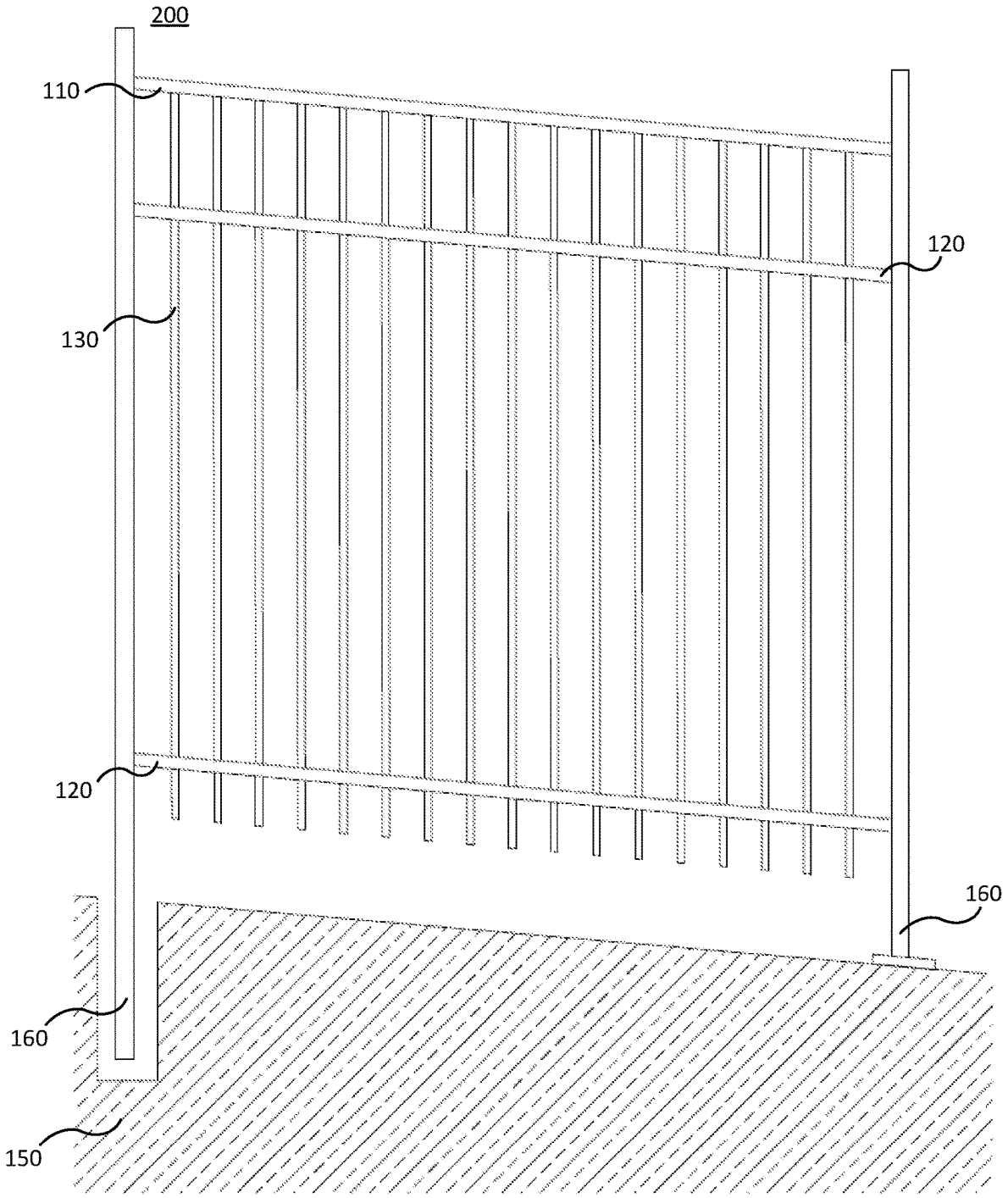
FIG. 2 is a front view of the panel of FIG. 1*a* in a second, racked position, according to an example configuration.

FIG. 2 illustrates a panel 200 in a tilted position. For the sake of clarity in illustrating the adjustable relationship between the main rail 110 and the one or more upright members 130, as shown, the main rail 110 is shifted from horizontal in order to follow the elevation changes of the uneven terrain making up the anchoring surface 150, and the one or more upright members 130 are shown as substantially vertical. As illustrated, one may define two anchor points: a first point where a post 160 at one end of the panel 200 meets the ground and a second point where a post 160 at the opposite end of the panel 200 meets the ground. A line between the two anchor points may then have a particular slope, and when the panel 200 is in its tilted position, the slope of the main rail 110 will substantially align with the slope of the line that may be defined between anchor points. In this way, when the panel 200 is anchored on ground where elevation decreases (the first anchor point being higher in elevation than the second), the main rail 110 will have a negative slope relative to horizontal. Conversely, when the panel 200 is anchored on ground where elevation increases, the main rail 110 will have a positive slope relative to horizontal. Whether the slope of the main rail 110 is negative or positive, the one or more upright members 130 will remain vertical. In embodiments including additional rails beyond the main rail 110, such as secondary rail 120, the additional rails will tilt approximately the same as the main rail 110 and follow approximately the same slope relative to horizontal as does the main rail 110.

As illustrated in FIG. 2, in embodiments where the panel 200 is anchored by posts, it should be noted that the posts will be substantially parallel to the one or more upright members 130, such as is shown with regard to posts 160. In this way, the posts will be substantially vertical regardless of the slope of the main rail 110 and any additional rails, such as secondary rail 120. As discussed in further detail below, this enables the second post anchoring the opposite end of a panel 200 to serve as the first post of an additional panel, creating a span of panels that may follow the elevation changes of uneven terrain.

Figure 3A:
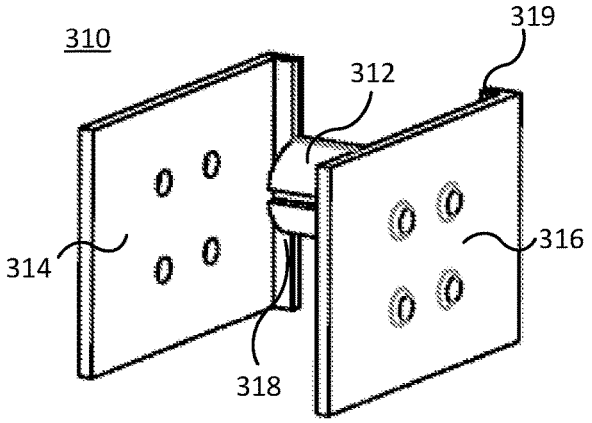
FIG. 3*a* is a plan view of a twistable bracket for use in the panel of FIG. 1*a*, according to an example configuration.
Figure 3B:
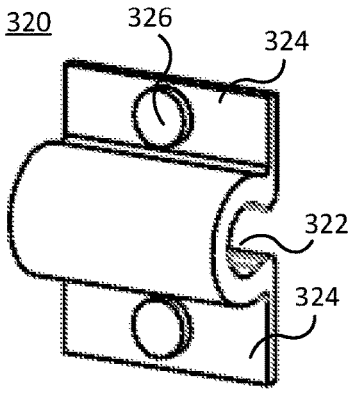
FIG. 3*b* is a plan view of an overlay bracket for use in the panel of FIG. 1*a*, according to an example configuration.
Figure 3C:
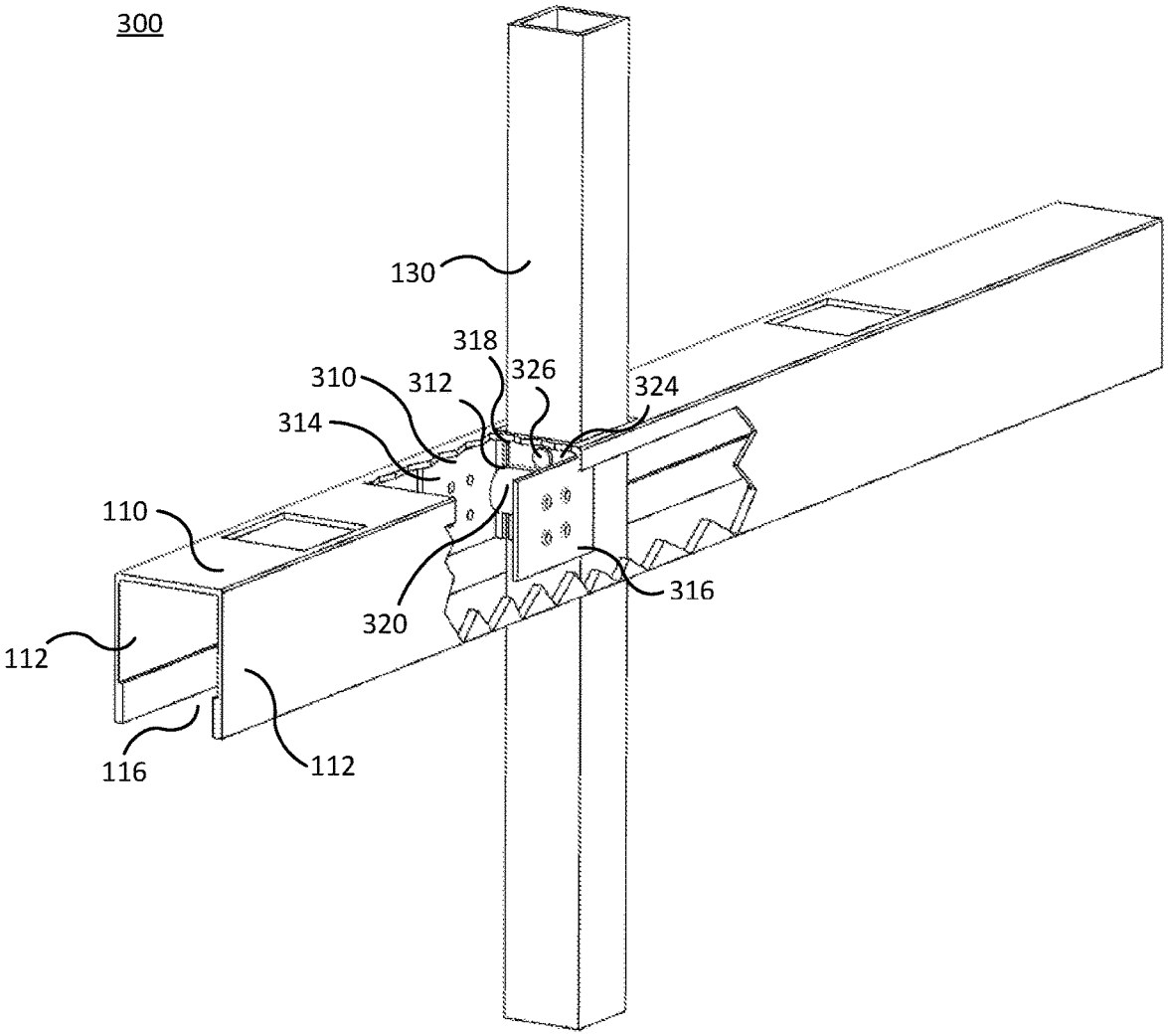
FIG. 3*c* is cut-through side view of a portion of the panel of FIG. 1A showing further detail of the components of FIGS. 3*a* and 3*b*, according to an example configuration.

FIGS. 3*a* through 3*c* illustrate the details of a coupling system 300 for indirectly coupling the one or more upright members 130 to the rail 110 and, in embodiments with additional rails, to each additional rail, such as secondary rails 120 shown in FIGS. 1-2. FIG. 3*a* shows a bracket 310 according to an embodiment, prior to implementation of the bracket 310. FIG. 3*b* shows an overlay 320 that, in implementation, may be mounted over a portion of bracket 310 such that that portion it is received within overlay 320, and overlay 320 may then be secured to a surface of a corresponding upright member. In this manner, overlay 320 is connected to the upright member 130 while bracket 310 is not connected to the upright member 130, such that indirect coupling of the rail and the upright member is accomplished. This indirect coupling of the rail and upright member permits a wide range of rackability for the panel while maintaining a stable connection between the rail 110 and the upright member 130, utilizing the fewest different types of components for the entire panel as possible.

As shown in FIG. 3*a*, bracket 310 includes a bridge 312 and rail plates 314, 316 extending substantially laterally from opposite sides of the bridge 312 via shoulders 318, 319. The bridge 312 may be substantially round, while the shoulders 318, 319 and the rail plates 314, 316 may be substantially planar. The shoulders 318, 319 may generally be formed of the same material as the bridge 312 and rail plates 314, 316. The shoulders 318, 319 may have the same width as the rail plates 314, 316. In alternative embodiments, the shoulders 318, 319 may have a narrower width than the rail plates 314, 316 and a wider width than the bridge 312. The bridge 312 may have the narrowest width of the portions of the bracket 310, such that in implementation, it may be received within the overlay 320 in the manner described in further detail below.

The shoulders 318, 319 may be, for example, a narrowing in the material from which bracket 310 is manufactured as between the portion of the bracket 310 that makes up the rail plates 314, 316. The bridge 312 may then be, for example, a further narrowing in the material from which bracket 310 is manufactured as between the portions of the bracket 310 that make up the shoulders 318, 319. The bridge 312 may be substantially round, such that the bridge 312 may rotate within the channel 322 of the overlay 320 when the coupling system 300 is fully implemented. In an embodiment, the bracket 310 is manufactured as a single piece, that is, bridge 312, shoulders 318, 319, and rail plates 314, 316 are a single piece of material. In such an embodiment, portions of the single piece of material may be rolled to form the substantially round bridge 312. In other embodiments, the bracket 310 may be manufactured as two or more pieces, that is, the bridge 312 may be a separate piece from the shoulders 318, 319 that are then connected during the manufacturing process, such as via a weld, and so on. In other embodiments, shoulders 318, 319 may be omitted from the bracket 310, such that the rail plates extend directly and substantially laterally from opposite sides of the bridge 312, without the intervening shoulders 318, 319.

In an embodiment, rail plates 314, 316 of the bracket 310 are bent away from the bridge 312 at the portion of each shoulder 318, 319 that is proximal to the bridge 312. The bends at each shoulder 318, 319 may be at an approximately 90 degree angle. In other embodiments, the bends at each shoulder 318, 319 may be greater than or less than 90 degrees. In other embodiments, shoulders 318, 319 may be omitted from the bracket 310, such that the rail plates extend directly and substantially laterally from opposite sides of the bridge 312, without the intervening shoulders 318, 319. In such embodiments, the rail plates 314, 316 may be at an approximately 90 degree angle to either end of the bridge 312.

As shown in FIG. 3*a*, rail plates 314, 316 may each be of a width substantially the same as the width of the bridge 312 and/or the combination of the bridge 312 and shoulders 318, 319, in embodiments that include shoulders 318, 319. However, in an alternative embodiment, the rail plates 314, 316 may be of a shorter width than the width of the bridge 312 and/or the bridge 312 and shoulders 318, 319, effectively reducing the surface area of the rail plates 318, 319 that connects to the sidewalls 112, and also reducing the material needed for bracket 310. In another embodiment, rail plates 314, 316 may be omitted entirely, such that the bracket 310 is connected to the sidewalls 112 of the rail 110 at either end of the bridge 312 or, if shoulders 318, 319 are included, at the end of each shoulder 318, 319.

As shown in FIG. 3B, overlay 320 includes a channel 322 for receiving the bridge 312 of the bracket 310, and at least one mounting plate 324 disposed on either side of the channel 322. The portion of the overlay 320 that includes channel 322 may be substantially U-shaped, with the mounting plates 324 extending substantially laterally from either side of channel 322 so that they may interface with and be secured to a surface of one of the upright members, leaving open the space that forms the channel 322. The channel 322 may be sized to be slightly larger in diameter than that of the bridge 312 of the bracket 310, so that when the bridge 312 is received within the channel 322 the bridge is rotatable but a strong, indirect connection is still made as described elsewhere. As shown, the mounting plates 324 of the overlay 320 may include one or more nodes 326 extending from the mounting plates 324 at which the mounting plates 324 may be, for example, resistance welded to the surface of one of the upright members. Still other embodiments may secure the mounting plates 324 to the corresponding upright member by other means, such as self-screw and adhesives, and may not include nodes 326. The overlay 320 may be formed from the same type of material as the bracket 310, or it may be formed from a different type of material. In an embodiment, the overlay 320 may only include one mounting plate 324.

Turning to FIG. 3*c*, the bracket 310 and overlay 320 according to an embodiment are shown in implementation, that is, indirectly coupling an upright member 130 to a rail 110 of a panel. Bracket 310 is sized such that it is entirely contained in rail channel 116 when it is implemented—that is, bracket 310 does not extend downward past the sidewalls 112 of the rail 110. In this manner, bracket 310 is not visible when looking at panel 100 from the side. In an embodiment, the rail plates 314, 316 may be sized such that they roughly correspond with the height and depth of the thinner portion of the sidewalls 112, so that when the rail plates 314, 316 are connected to the sidewalls 112 as further described, a stable connection forming a substantially flat inner sidewall surface at the interface of the sidewalls 112 and the rail plates 314, 316 is formed.

Bracket 310 may be connected to the sidewalls 112 of rail 110 at each of rail plates 314, 316, in an embodiment. For example, bracket 310 may be connected to rail 110 via a welded connection of the rail plates 314, 316 to the corresponding sidewalls 112 of the rail 110. Upright member 130 may then be placed within the rail channel 116 and overlay 320 may then be mounted over bridge 312 of bracket 310 such that bridge 312 is received within channel 322 of the overlay 320. Overlay 320 may then be secured to upright member 130 via the at least one mounting plate 324. For example, overlay 320 may be secured to a surface of upright member 130 via a welded connection of the mounting plates 324 to the upright member 130, similar to the connection between the rail plates 314, 316 and sidewalls 112 of the rail 110. In this way, bridge 312 may be held within overlay 320 in a manner that permits the bridge 312 to rotate within the channel 322 of the overlay, while the upright member 130 and the rail 110 are indirectly connected via the implementation of the bracket 310 and overlay 320, since neither bridge 312 nor any other portion of the bracket 310 is directly connected to upright member 130. Thus, in implementation, the bracket 310 is directly connected to the sidewalls 112 of the rail 110 but is not directly connected to the upright member 130. This indirect coupling of the rail and upright member permits a wide range of rackability for the panel while maintaining a stable connection between the rail 110 and the upright member 130.

As shown in FIG. 3*c*, when the bracket 310 and overlay 320 are implemented to indirectly couple upright member 130 to rail 110, said coupling is further accomplished by connecting a first side (the side facing outward) of each rail plate 314, 316 to the inner side of each sidewall 112 of the rail 110, such as by welding the rail plates 314, 316 to the inner side of each sidewall 112. In this manner, bracket 310 and overlay 320 connect upright member 130 to rail 110 without any connection between the upright member 130 and the topside 114 of the rail 110. Thus, the same style of bracket 310 and overlay 320 can be used regardless of whether upright member 130 is coupled to a rail 110 that has openings 140 in the topside 114 for receiving upright member 130 and permitting upright member 130 to pass through, or a rail 110 that has no openings 140 in the topside 114 (i.e., a flat top rail). Being able to use the same style of bracket 310 and overlay 320 regardless of whether the upright member 130 is coupled to a rail 110 with openings or a rail 110 without openings simplifies manufacturing and assembly of the disclosed rackable panel.

Further, because bracket 310 and overlay 320 cooperate to indirectly connect upright member 130 to the inner sidewalls 112 of the rail, rather than to the top wall 114 of the rail, the rails 110, 120 need not have any special configuration themselves in order to connect to the upright members 130. As a result, only four main component parts are needed for panels featuring upright members 130 that extend through each rail 110, 120: rails 110, 120 with holes 140 for receiving each upright member 130, upright members 130, the appropriate plurality of brackets 310, and the appropriate plurality of overlays 320 all in the same style for connecting each upright member 130 to each rail 110, 120. Similarly, in panels featuring uprights members that extend through one or more rails 120 but do not extend through the main rail 110 (i.e., flat top panels), only five main component parts are needed: the main rail 110 with no openings 140 for receiving upright members 130, one or more additional rails 120 with openings 140 for receiving upright members 130, upright members 130, the appropriate plurality of brackets 310, and the appropriate plurality of overlays 320 all in the same style for connecting each upright member 130 to each rail 110, 120. In this manner, manufacturing of the component parts for a rackable panel according to embodiments of the invention is simplified, as is assembly of the rackable panel.

In an embodiment, a separate bracket 310 and overlay 320 is included for every upright member 130 in the panel 100 at every junction between an upright member 130 and a rail. For example, in an embodiment panel 100 that includes two rails 110, 120 and ten upright members 130, there are twenty junctions between the upright members 130 and rails 110, 120, so there are twenty separate brackets 310 and twenty separate overlays 320 in the panel 100, such that every upright member 130 is indirectly connected to both rails 110, 120 through the cooperation of a bracket 310 and an overlay 320 at both junctions. Thus, when the described coupling system is applied to a panel having a plurality of upright members 130, the upright members 130 are held in place by a plurality of brackets and overlays between opposing sidewalls 112 of the main rail 110, and the upright members 130 extend through the openings 140 in the main rail 110 or, in flat-top embodiments, terminate within the rail channel 116 of the main rail 110. In this way, the upright members 130 may be indirectly secured to the main rail 110 only at the side walls 112 and mounting plates 324 of the overlays 320, leaving clearance all the way around the upright members 130 where they extend through the openings of the panel or fit within the rail, in flat-top embodiments, permitting a wider range of vertical and/or horizontal movement of the upright member 130 within the opening 140 and, as a result, a greater range of angles for racking the panel.

As discussed, embodiments of the bracket 310 may use only a single rail plate extending from the bridge 312, either directly or via a single shoulder. In such embodiments, the single plate is secured to one wall of the main rail, the bridge is received in the overlay, and the overlay is secured to the upright member, allowing for an indirect connection between the upright member and the rail.

Figure 4B:
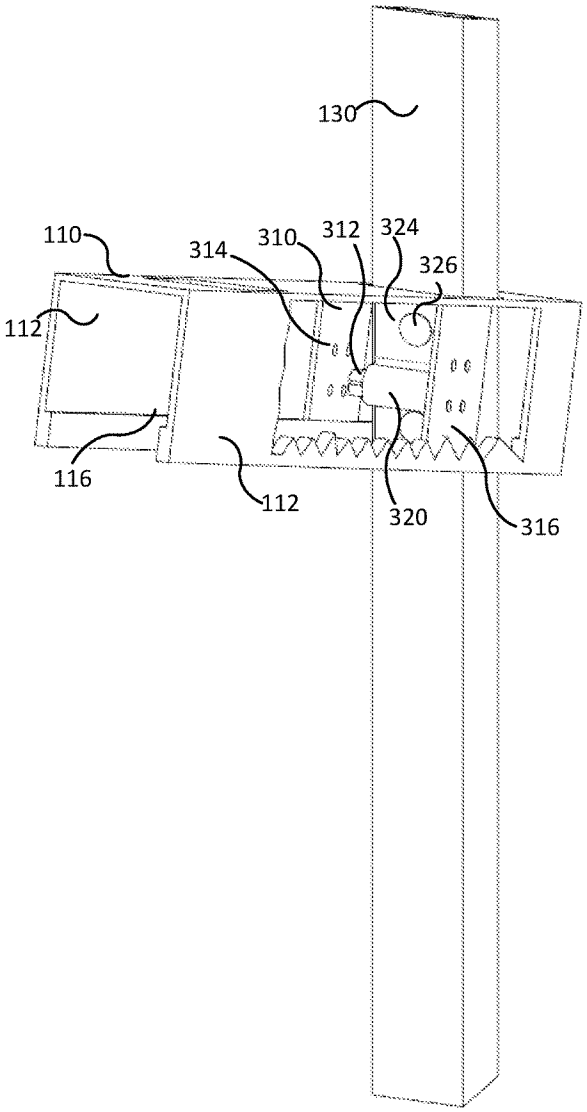
FIG. 4*b* is a cut-through side view of a portion of the panel of FIG. 1*a* showing further details of the components of a panel for a rackable fencing system while in a first racked position, according to an example configuration.
Figure 4A:
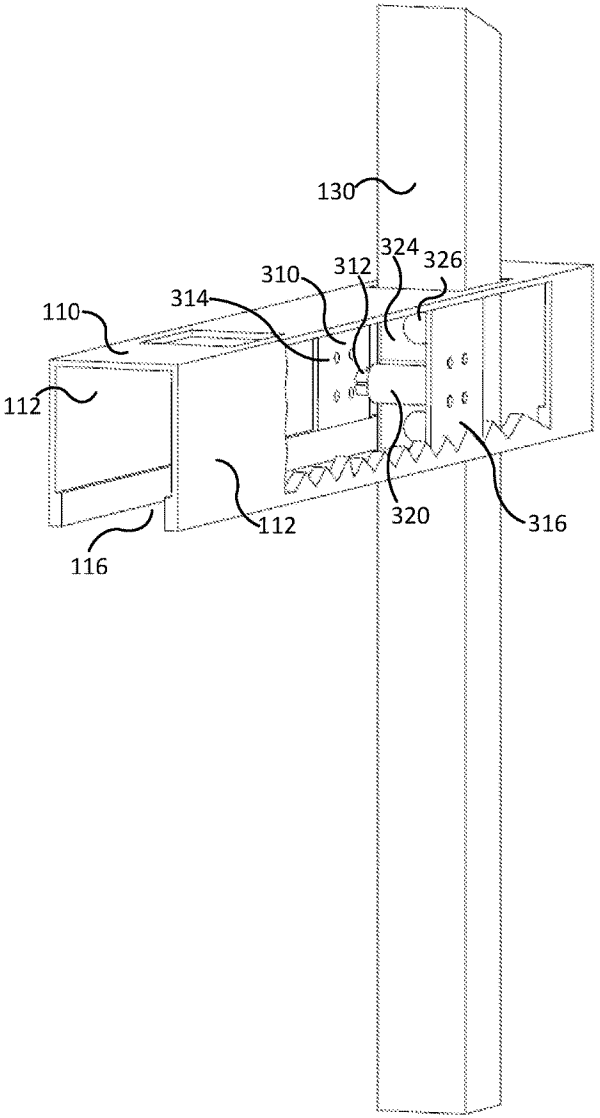
FIG. 4*a* is a cut-through side view of a portion of the panel of FIG. 1*a* showing further details of the components of a panel for a rackable fencing system while in a default, horizontal position, according to an example configuration.

FIGS. 4*a* and 4*b* show, in greater detail, the bracket 310 and overlay 320 as implemented in a rail of a panel through which the upright member 130 passes, such as secondary rails 120 in FIG. 1*a*, when the panel is in its normal default, substantially horizontal position (FIG. 4*a*) and when the panel is racked to a slope (FIG. 4*b*). Secure connections are formed between the bracket 310 and the sidewalls 112 of the main rail 110, the bridge 312 of the bracket 310 is received in the channel 322 of the overlay 320, and the overlay 320 is securely connected to the upright members 130 via one or more mounting plates 324. Components may then be moved from their initial positions to enable the tiltable relationship between the one or more upright members 130 and the main rail 110 previously described. Specifically, the bridge 312 of bracket 310 may rotate while supported within the channel 322 of the overlay 320, as the main rail 110 is tilted relative to the upright members 130 to achieve the desired slope. For instance, if the main rail 110 must be tilted such that it has a positive slope between anchoring posts (i.e., it must accommodate an elevation gain), the bridge 312 of the bracket 310 may rotate one direction while supported within the channel 322 of the overlay 320 such that the rail plates 314, 316 may tilt relative to the anchoring surface at substantially the same angle as the main rail 110. In this way, the bracket 310 may move with the main rail 110 via the rotation of the bridge 312 of the bracket 310 within the channel 322 of the overlay 320 without substantially changing the position of the overlay 320, such that upright members 130 remain substantially vertical while rail 110 and any additional rails 120 tilt relative to the anchoring surface. As shown in FIG. 4*b*, this rotation of the bracket 310 causes the horizontal alignment of the upright member 130 and the rail 110 to change somewhat, which is why in embodiments where rail 110 includes openings 140, openings 140 are sized such that upright members 130 can pass through the openings 140 and be able to move horizontally and/or vertically when panel 100 is in a racked position. Alternatively, if the main rail 110 must be tilted such that it has a negative slope, the bridge 312 of the bracket 310 may rotate in the opposite direction within the channel 322 of the overlay 320.

Figure 5B:
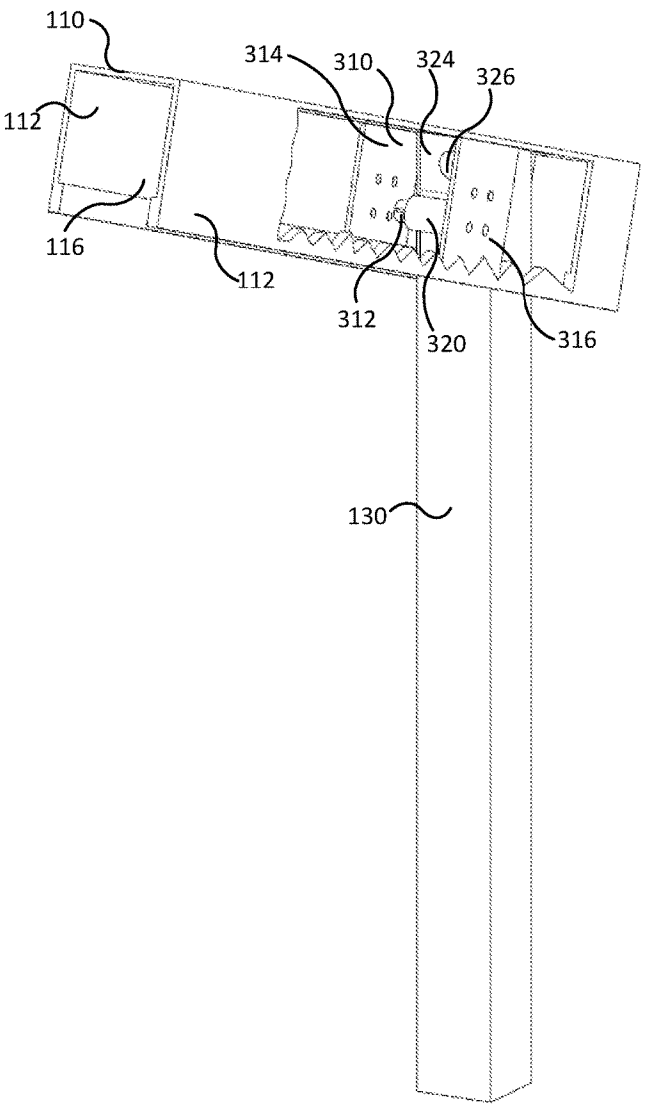
FIG. 5*b* is a cut-through side view of a portion of the panel of FIG. 1*a* showing further details of the components of a panel for a rackable fencing system while in a first racked position, according to an example configuration.
Figure 5A:
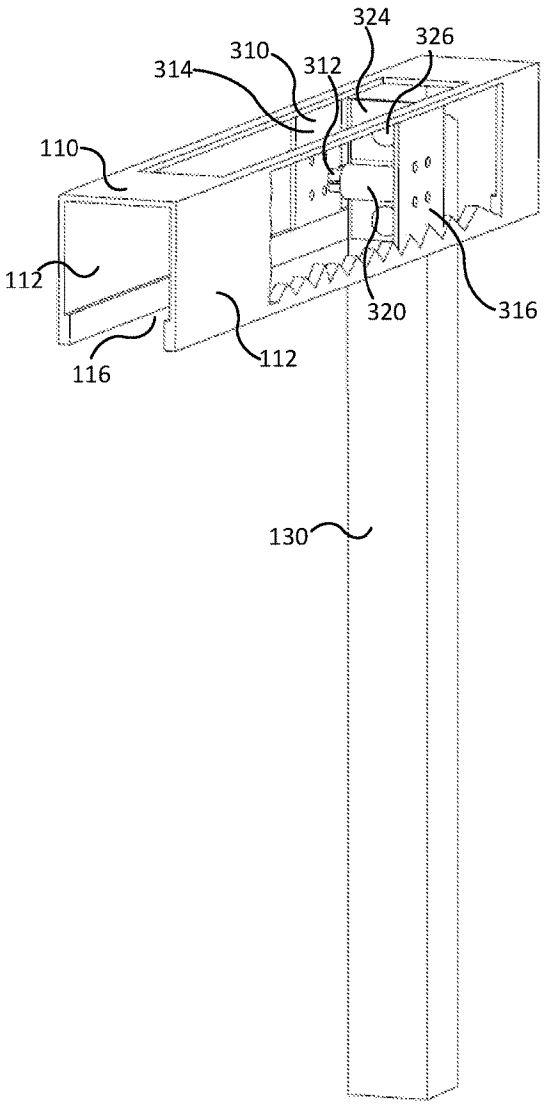
FIG. 5*a* is a cut-through side view of a portion of the panel of FIG. 1*a* showing further details of the components of a panel for a rackable fencing system while in a default, horizontal position, according to an example configuration.

FIGS. 5*a* and 5*b* show, in greater detail, the bracket 310 and overlay 320 as implemented in a rail of a panel through which the upright member 130 does not pass (i.e., a flat-top rail), such as rail 110 in FIG. 1*a*, when the panel is in its normal default, substantially horizontal position (FIG. 5*a*) and when the panel is racked to a slope (FIG. 5*b*). Secure connections are formed between the bracket 310 and the sidewalls 112 of the main rail 110, the bridge 312 of the bracket is received in the channel 322 of the overlay 320, and the overlay 320 is securely connected to the upright members 130 via the one or more mounting plates 324. Components may then be moved from their initial positions to enable the tiltable relationship between the one or more upright members 130 and the main rail 110 previously described. Specifically, the bridge 312 of the bracket 310 may rotate while supported within the channel 322 of the overlay 320, as the main rail 110 is tilted relative to the upright members 130 to achieve the desired slope. For instance, if the main rail 110 must be tilted such that it has a positive slope between anchoring posts (i.e., it must accommodate an elevation gain), the bridge 312 of the bracket 310 may rotate one direction while supported within the channel 322 of the overlay 320 such that the rail plates 314, 316 may tilt relative to the anchoring surface at substantially the same angle as the main rail 110. In this way, the bracket 310 may move with the main rail 110 via the rotation of the bridge 312 of the bracket 310 within the channel 322 of the overlay 320 without substantially changing the position of the overlay 320, such that upright members 130 remain substantially vertical while rail 110 and any additional rails 120 tilt relative to the anchoring surface. As FIGS. 5*a*-5*b* demonstrate, by utilizing the disclosed coupling system 300, the same bracket 310 and overlay 320 can be used to form an indirect connection between the upright members 130 and the rails-regardless of whether the rails are flat-top rails, such as rail 110 in FIG. 1*a* (FIGS. 5*a*-5*b*), or are rails with holes 140 through which upright members 130 pass, such as rails 120 in FIG. 1*a* (FIGS. 4*a*-4*b*). By using the same coupling system 300 regardless of rail type, the manufacture, production, and assembly of the disclosed panels is simpler and more cost-effective than if specialized bracket assemblies were needed for different rail types.

As already discussed, by utilizing the coupling system 300 disclosed herein, the manufacturing and assembly of an embodiment rackable fence panel is simplified because the same bracket 310 and overlay 320 can be used at each junction between an upright member 130 and a rail 110, 120, regardless of whether the rail is of the sort that includes a hole through which the upright member 130 protrudes (as in FIG. 1*a*, rails 120), or is of the sort that does not include a hole through which the upright member 130 protrudes (i.e., a flat-top rail, as in FIG. 1*a*, rail 110). Additionally, the indirect connection between the upright member 130 and the rail sidewalls 112 provides a stronger interface between the upright member 130 and the rail 110, 120 than if no overlay 320 were used such that the bracket 310 itself was welded to the upright member 130. By utilizing both the bracket 310 and overlay 320 to achieve connection, a stable connection remains even if one portion of the coupling system 300 were to fail or underperform.

The rotatable nature of the bridge 312 of the bracket 310 within the channel 322 of the overlay 320 permits nearly infinite racking angles for the panel 100, permitting the panel 100 to be used on a wide variety of terrains while keeping upright members 130 substantially vertical, not tilted. That is, by utilizing the components and rotation methods disclosed here, the panel 100 may be adjustable to any elevation change on uneven terrain. Embodiments described here allow the main rail 110 (and any additional rails) of the panel 100 to tilt to a desired slope between posts that anchor the panel 100, while maintaining the one or more upright members 130 in a vertical position parallel to the posts. One of the posts anchoring the panel 100 may then serve as the anchor for an additional panel, which may then also be adjusted to a slope following the elevation change of the terrain. This may continue over a span of terrain, connecting the disclosed panels and adjusting them to fit the respective terrain on which they are anchored, forming a complete fence that follows the contours of the terrain without needing to customize each panel in the manufacturing process.

In an embodiment method of assembling the disclosed rackable panel, assembly begins with the desired number of rails (for example, one main rail 110 and two additional rails 120, as shown in FIG. 1*a*), the desired number of upright members 130, and the required number of coupling systems 300 (comprised of bracket 310 and overlay 320), each as separate pieces. In an embodiment, the brackets 310 are first connected to the internal side walls of the rails, one bracket 310 at each junction that will be formed between the rails and the upright members 130. Said connection may be accomplished through, for example, welding the rail plates of the bracket 310 to the inner side walls of the rail, as previously discussed. The rails are then set on a weld jig and the upright members 130 are passed through the holes 140 in the rails, adjacent the bridge 312 of the bracket 310, but without connecting bridge 312 to the upright member 130. For each bracket 310, an overlay 320 is implemented, such that the bridge 312 of the bracket 310 is received in the channel 322 of the overlay 320. The overlay is then welded to the upright member via the one or more mounting plates 324, forming a stable, but indirect connection between the upright member and the rail that permits nearly infinite angles of rackability as the bridge 312 rotates in the channel 322 of the overlay 320. This method of establishing an indirect connection between the upright member 130 and the rail via the coupling system 300 is implemented at each junction between the upright members and the rails of the panel, until all junctions are connected. In this manner, a stable, easy-to-assemble and easy-to-use rackable panel is produced, which can be used on various terrains as already discussed.

Components of the described panel and coupling system may preferably be made of a strong, durable material such as sheet steel, aluminum, or a plastic such as polyvinyl chloride. In embodiments of the coupling system utilizing resistance welding, components may be formed from a conductive metal or other conductive material.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular example configuration, that feature can also be used, to the extent possible, in the context of other example configurations.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Also, directions such as "vertical," "horizontal," "right," and "left" are used for convenience and in reference to the views provided in figures. But the disclosed barrier may have a number of orientations in actual use. Thus, a feature that is vertical, horizontal, to the right, or to the left in the figures may not have that same orientation or direction in actual use.

Although specific example configurations have been described for purposes of illustration, it will be understood that various modifications may be made without departing from the spirit and scope of the disclosure.

What is claimed is:

1. A panel for a barrier, comprising:

a primary rail having a top wall, a first wall, and a second wall, the first and second walls each extending downward from opposing sides of the top wall of the rail, and a channel disposed between the first and second walls;

one or more upright members structured to fit partially within the channel of the rail;

one or more brackets structured to be secured to an inner surface of either of the first and second walls of the rail, the one or more brackets each having a bridge and at least one rail plate extending substantially laterally from a side of the bridge, the at least one rail plate structured to be secured to an inner surface of either of the first and second walls of the rail; and one or more overlays, separate from the one or more brackets, structured to fit over the one or more brackets and be secured to a surface of the one or more upright members, the one or more overlays being structured to fit over the bridge of the one or more brackets, and the bridge of the bracket is received within a channel of the one or more overlays, the channel formed by a substantially U-shaped portion of the overlay.

2. The panel of claim 1, in which the rail plate and the one or more overlays each include one or more attachment nodes.

3. The panel of claim 2, in which the rail plate is secured to the inner surface of either of the first and second walls of the rail and the overlays are secured to the upright members through resistance welding at the one or more attachment nodes.

4. The panel of claim 1, in which the bridge of the one or more brackets are structured to be rotatable within the channel of the one or more overlays when a force is applied.

5. The panel of claim 4, in which a slope of the panel is adjustable by applying a force to rotate the one or more brackets.

6. The panel of claim 1, further comprising at least one secondary rail, the secondary rail having one or more openings structured to receive the one or more upright members.

7. A panel for a barrier, comprising:

a rail having a top wall, a first wall, and a second wall, the first and second walls each extending downward from opposing sides of the top wall of the rail, and a channel disposed between the first and second walls;

one or more upright members structured to fit partially within the channel of the rail;

one or more brackets structured to indirectly couple the one or more upright members with the rail, the one or more brackets including:

a bridge, and one or more rail plates extending substantially laterally from a side of the bridge and structured to be secured to the rail at a first rail attachment point on an inner surface of the first wall of the rail and a second rail attachment point on an inner surface of the second wall of the rail; and one or more overlays structured to fit over the bridge and to be secured to the one or more upright members such that the bridge is received within a channel of the one or more overlays, the channel formed by a substantially U-shaped portion of the overlay.

8. The panel of claim 7, in which the one or more brackets include one or more attachment nodes at the first and second rail attachment points, and the one or more overlays include one or more attachment nodes at an upright member attachment point.

9. The panel of claim 8, in which the brackets are secured to the rail and the overlays are secured to the upright members through resistance welding at the one or more attachment nodes.

10. The panel of claim 7, in which the one or more brackets are structured to be rotatable within the channel of the one or more overlays when a force is applied.

11. The panel of claim 10, in which a slope of the panel is adjustable by applying a force to rotate the one or more brackets.

12. The panel of claim 7, further comprising one or more additional rails having one or more openings, the one or more upright members further structured to pass through the one or more openings in the one or more additional rails.

13. A panel for a barrier, comprising:

a primary rail having a top wall, one or more openings on the top wall, first and second walls extending downward from opposing sides of the top wall of the primary rail, and a channel disposed between the first and second walls;

one or more upright members structured to fit partially within the channel of the primary rail and pass through the one or more openings in the top wall of the primary rail;

one or more overlays; and one or more brackets, separate from the one or more overlays, secured to an inner surface of either of the first and second walls and structured to be received by an overlay secured to a surface of the one or more upright members, wherein the one or more brackets indirectly couple the one or more upright members with the rail, the one or more brackets each including a bridge and at least one rail plate extending substantially laterally from a side of the bridge, the at least one rail plate structured to be secured to an inner surface of either of the first and second walls of the rail, and the bridge structured to be received within a channel of the overlay, the channel formed by a substantially U-shaped portion of the overlay.

14. The panel of claim 13, in which the rail plate and the overlay each include one or more attachment nodes, and the rail plate is secured to the inner surface of either of the first and second walls of the rail and the overlay bracket is secured to the one or more upright members through resistance welding at the one or more attachment nodes.

15. The panel of claim 13, in which the bridge of the one or more brackets are rotatable within the channel of the one or more overlays when a force is applied.

16. The panel of claim 15, in which a slope of the panel is adjustable by applying a force to rotate the one or more brackets.

17. The panel of claim 13, further comprising one or more additional rails, each one or more additional rails having a top wall with one or more openings, the one or more upright members further structured to pass through the one or more openings in the one or more additional rails.

* * * * *